US006817424B1

(12) United States Patent
Su et al.

(10) Patent No.: US 6,817,424 B1
(45) Date of Patent: Nov. 16, 2004

(54) ADJUSTABLE HOUSING FOR A HAND TOOL

(75) Inventors: Yu-Min Su, Taichung (TW); Chen-Chen Cheng, Taichung (TW)

(73) Assignee: Techway Industrial Co., Ltd., Taichung (TW)

( * ) Notice: Subject to any disclaimer, the term of this patent is extended or adjusted under 35 U.S.C. 154(b) by 0 days.

(21) Appl. No.: 10/688,885

(22) Filed: Oct. 21, 2003

(51) Int. Cl.[7] ..... B25D 17/00
(52) U.S. Cl. ..... 173/217; 173/216; 310/50
(58) Field of Search ..... 173/170, 216, 173/217; 310/47, 50

(56) References Cited

U.S. PATENT DOCUMENTS 4,759,240 A * 7/1988 Lin ..... 81/177.8
4,912,349 A * 3/1990 Chang ..... 310/50
5,372,420 A * 12/1994 Van Deursen et al. ..... 366/129
6,039,126 A * 3/2000 Hsieh ..... 173/216
6,364,033 B1 * 4/2002 Hung et al. ..... 173/217
6,467,556 B2 * 10/2002 Alsruhe ..... 173/217

* cited by examiner

*Primary Examiner*—Eugene Kim
*Assistant Examiner*—Nathaniel Chukwurah
(74) *Attorney, Agent, or Firm*—Bacon & Thomas PLLC

(57) ABSTRACT

A housing for a hand tool has a head, a handle and two positioning devices. The head is composed of two half casings each having a first adjusting base with a recess. The handle is pivotally attached to the head and is composed of two half casings each having a second adjusting base with a recess. The positioning devices are respectively mounted between the aligning recesses of the first and second adjusting bases on the head and the handle. Each positioning device has a pressing disk, a pressed disk and a biasing member. Each disk has a guiding block and a positioning block. The guiding block is formed on the disk and has two curved guiding edges selectively abutting against one end of the positioning block on the abutting disk. With such an arrangement, the housing can be adjusted between two positions easily and conveniently.

5 Claims, 5 Drawing Sheets

ADJUSTABLE HOUSING FOR A HAND TOOL

BACKGROUND OF THE INVENTION

1. Field of the Invention

The present invention relates to a housing, and more particularly to an adjustable housing for a pneumatic or an electrical hand tool that can be adjusted between two positions easily and conveniently.

2. Description of Related Art

A pneumatic or an electrical hand tool has a housing to enclose an internal mechanism in the housing for a user to conveniently hold the housing to operate the hand tool. The traditional housing for a hand tool in accordance with the prior art substantially comprises two half casings combined with each other to define a chamber for receiving the internal mechanism. The housing is formed as a head portion with an operation portion and a handle portion to be gripped by a user. A rotating shaft of the internal mechanism extending out from the head portion is connected to a tool head such as a screwdriver head, so that the user can hold the hand tool to tighten or release a fastener.

However, because the head portion and the handle portion of the traditional housing are integrally combined together and cannot be adjusted at an angle, the use of a hand tool with a traditional housing is not versatile. Therefore, a housing with an adjusting device is provided to adjust the housing at two different positions for versatile use. To keep the housing at a locked condition, a positioning device is mounted in the adjusting device to keep the housing from unintentionally moving to another position while the handle tool is in operation. A button is mounted in the positioning device for releasing the locked condition of the positioning device when the user wants to change the position of the housing. Therefore the button must be pushed before the housing is adjusted, the use of the conventional housing with an adjusting device is inconvenient.

To overcome the shortcomings, the present invention tends to provide a housing with an adjusting device to mitigate or obviate the aforementioned problems.

SUMMARY OF THF INVENTION

The main objective of the invention is to provide a housing for a handle tool and that can be adjusted between two positions easily and conveniently. The housing has a head, a handle and two positioning devices. The head is composed of two half casings combined with each other, and each half casing has a first adjusting base and a recess with an inner surface defined in the first adjusting base. The handle is pivotally attached to the head and is composed of two half casings combined with each other. Each half casing of the handle has a second adjusting base and a recess. Each second adjusting base corresponds to the first adjusting base on a corresponding one of the half casings of the head. The recess is defined in the second adjusting base and aligns with the recess in the corresponding first adjusting base. The positioning devices are respectively mounted between the aligning recesses of the first and second adjusting bases on the head and the handle. Each positioning device has a pressing disk, a pressed disk and a biasing member. The pressing disk and the pressed disk are non-rotatably received respectively in the aligned recesses of the first and second adjusting bases and abut against each other. Each of the pressing and pressed disks has a central hole, a guiding block and a positioning block. The guiding block is formed on the disk and has two curved guiding edges selectively abutting against one end of the positioning block on the abutting disk. The biasing member abuts against one* of the pressing disk and the pressed disk and provides a restituted force to the abutting disk to abut the pressing disk against the pressed disk.

Other objects, advantages and novel features of the invention will become more apparent from the following detailed description when taken in conjunction with the accompanying drawings.

BRIFF DESCRIPTTON OF THE DRAWINGS

DETAILED DESCRIPTION OF PREFERRED EMBODIMENT

Figure 1:
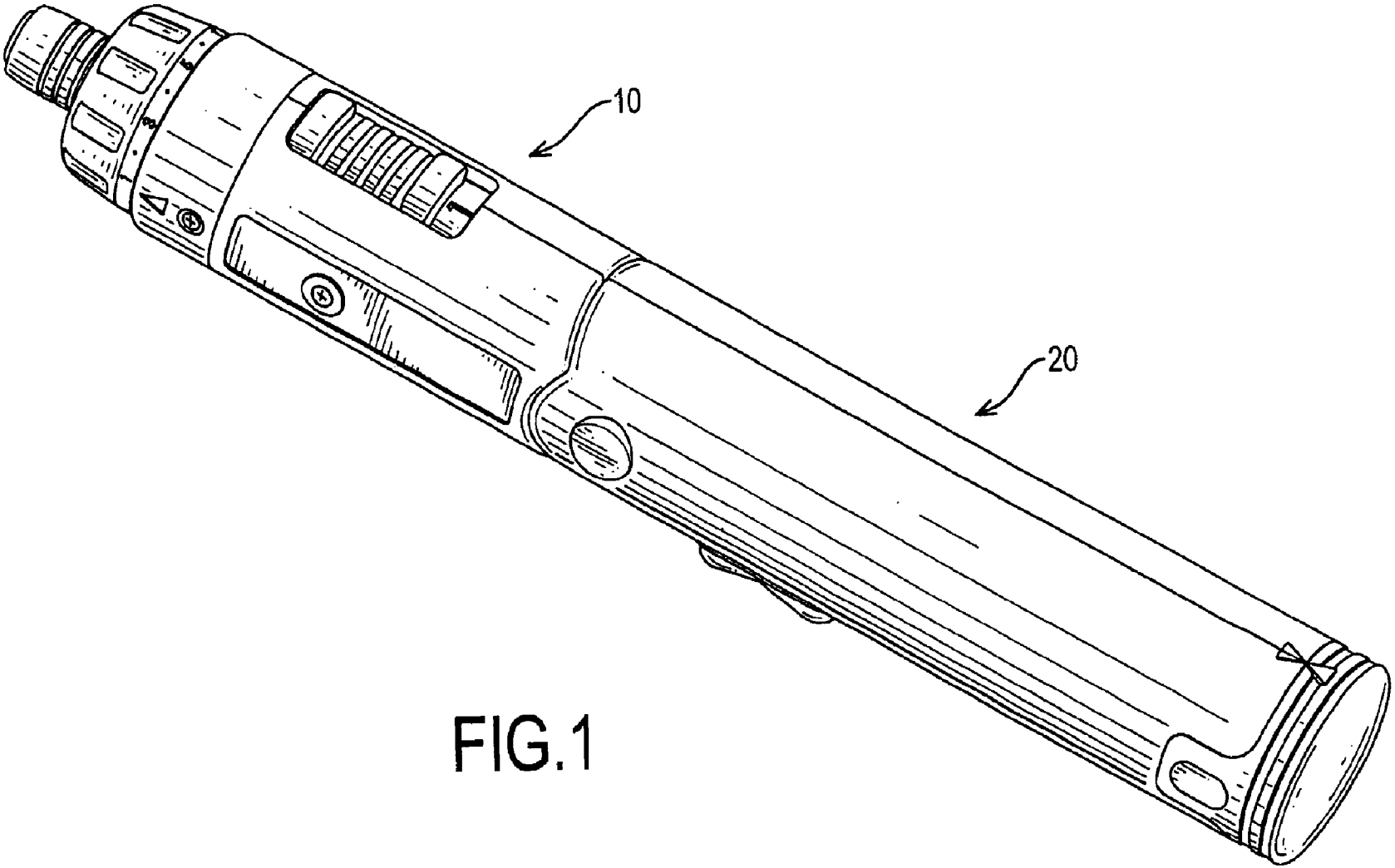
FIG. 1 is a perspective view of a hand tool with a housing in accordance with the present invention.
Figure 2:
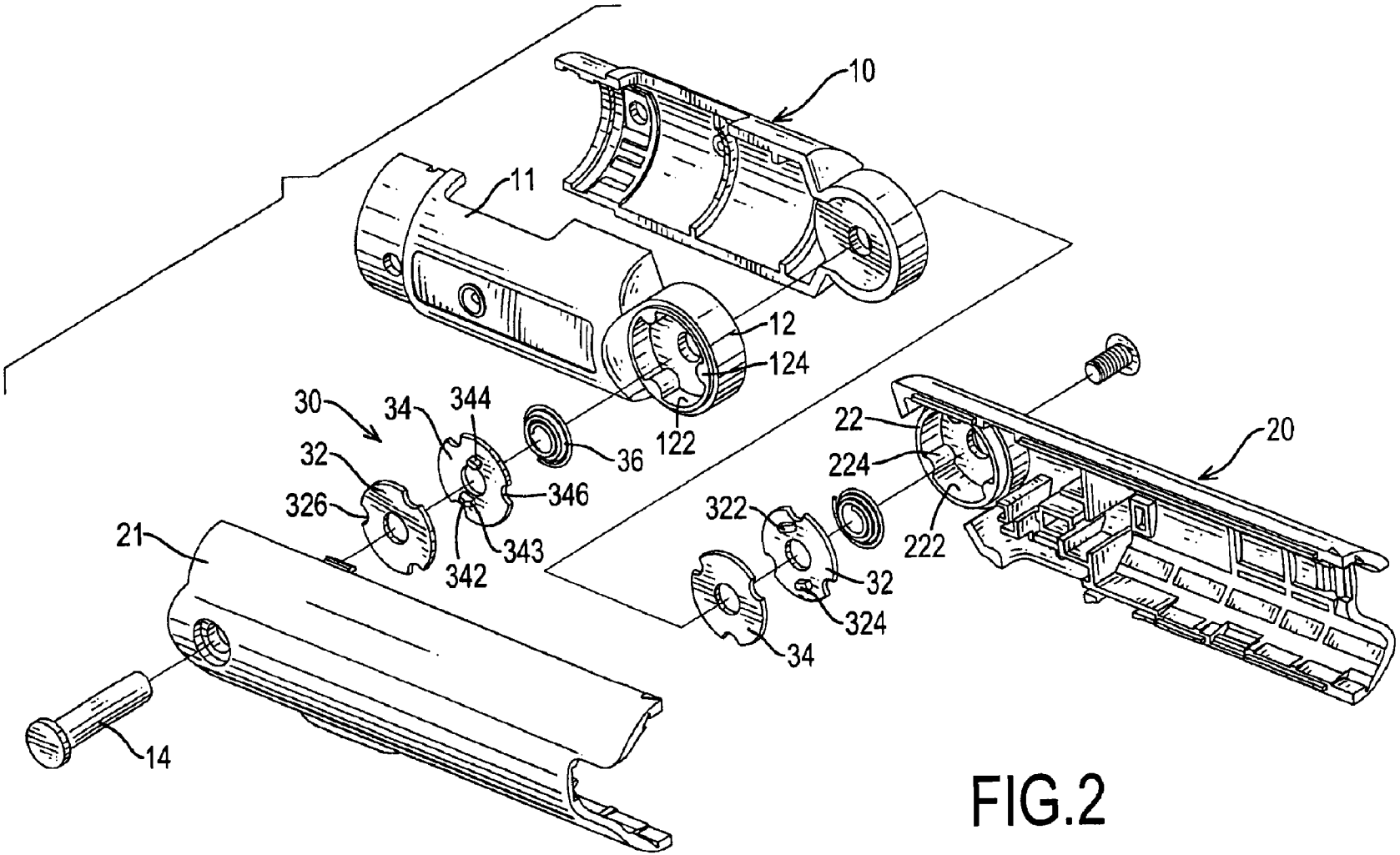
FIG. 2 is an exploded perspective view of the housing in accordance with the present invention.

With reference to FIGS. 1 and 2, a housing for a pneumatic or an electrical hand tool in accordance with the present invention comprises a head (10), a handle (20), a pivot (14) and two positioning devices (30). The head (10) has a proximal end (not numbered) and a distal end (not numbered) and is composed of two half casings (11) combined with each other to define a chamber (not numbered) in the head (10). Each half casing (11) has a first adjusting base (12) and a recess (122). The first adjusting base (12) is formed on the half casing (11) at the proximal end of the head (10). The recess (122) is defined in the first adjusting base (12) and has an inner surface. In an optional embodiment, the recess (122) is defined in the first adjusting base (12) at a side far away from the other first adjusting base (12). In an alternative embodiment, the recess (122) is defined in the first adjusting base (12) at a side facing the other first adjusting base (12).

The handle (20) has a proximal end (not numbered) pivotally attached to the proximal end of the head (10) and a distal end (not numbered) and is composed of two half casings (21) combined with each other to define a chamber (not numbered) in the handle (20). The hand tool has an internal mechanism (not shown) mounted in the chambers in the head (10) and the handle (20). Each half casing (21) of the handle (20) has a second adjusting base (22) and a recess (222). The second adjusting bases (22) are formed on the half casings (21) at the proximal end of the handle (20) and correspond respectively to the first adjusting bases (12) on the half casings (11) of the head (10). The recess (222) is defined in the second adjusting base (22), faces the recess (122) in the corresponding first adjusting base (12) and has an inner surface. In an optional embodiment, the recess (222) is defined in the second adjusting base (22) at a side facing the other second adjusting base (22) when the recess (122) is defined in the first adjusting base (12) at a side far away from the other first adjusting base (12). In an alternative embodiment, the recess (222) is defined in the second adjusting base (22) at a side away from the other second adjusting base (22) when the recess (122) is defined in the first adjusting base (12) at a side facing the other first adjusting base (12).

The pivot (14) extends through the adjusting bases (12, 22) on the head (10) and the handle (20) to pivotally connect the head (10) with the handle (20).

Figure 3:
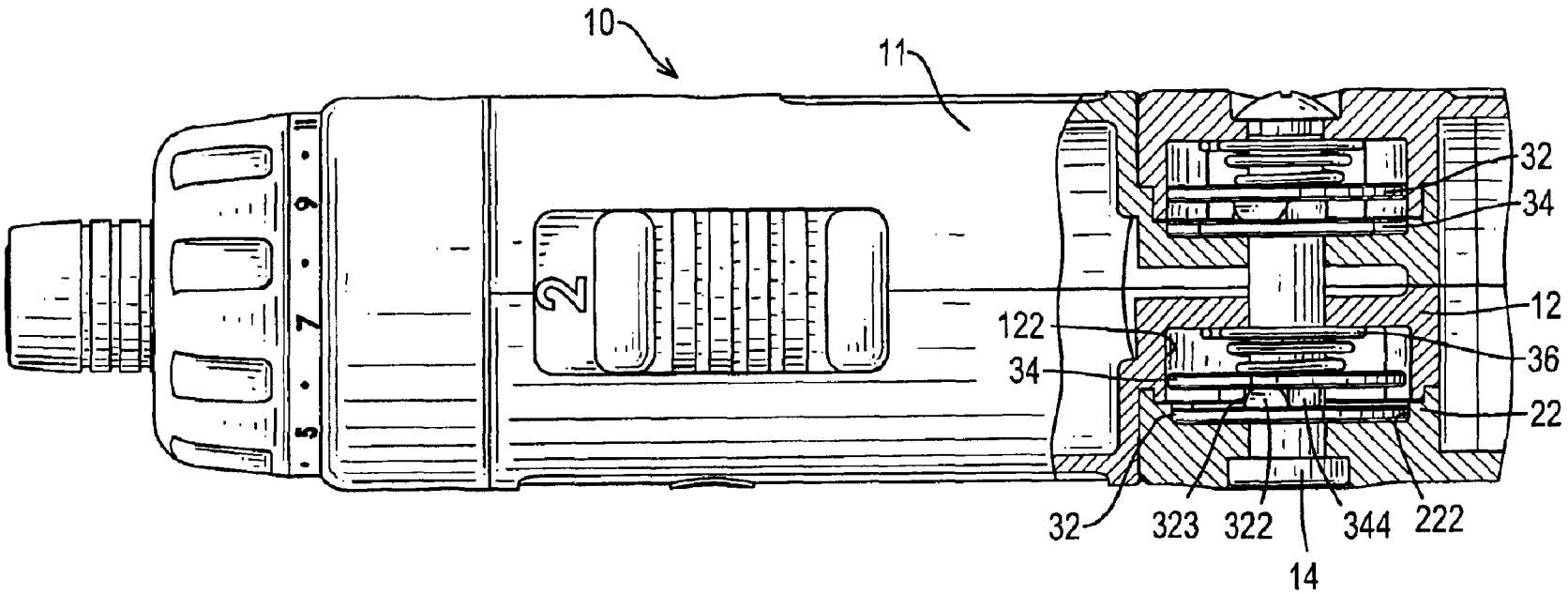
FIG. 3 is a top plan view in partial section of the hand tool with the housing in FIG. 1.
Figure 5:
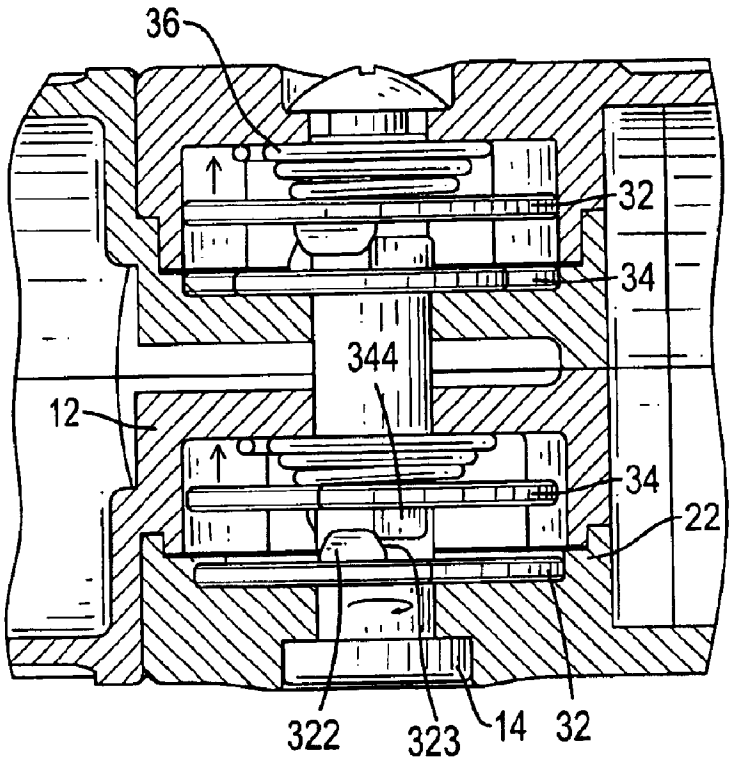
FIG. 5 is an operational enlarged top plan view in partial section of the housing in FIG. 4.
Figure 4:
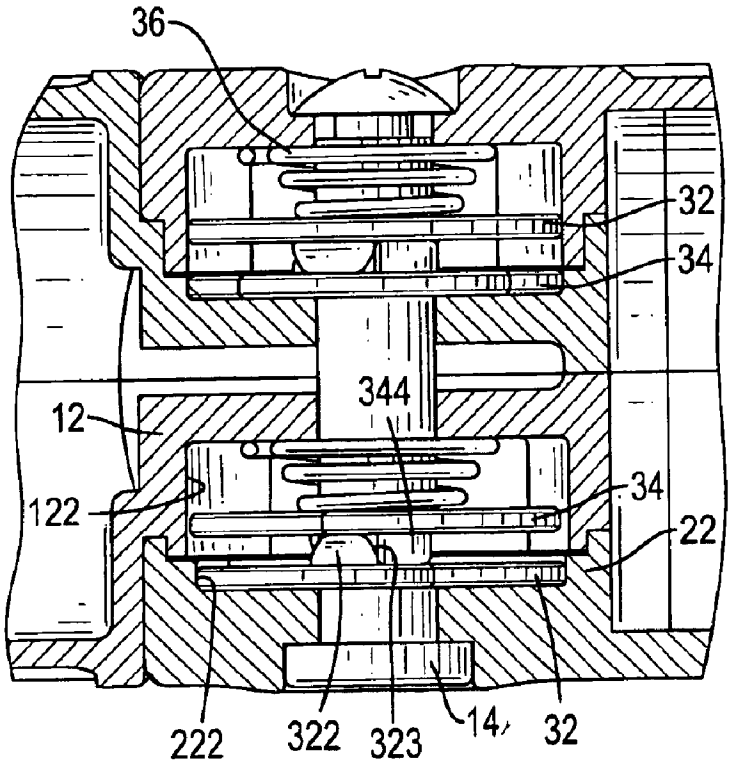
FIG. 4 is an enlarged top plan view in partial section of the housing in FIG. 3.

The positioning devices (30) are respectively mounted between the facing recesses (122,222) in the first and second adjusting bases (12,22) on the head (10) and the handle (20) to selectively keep the head (10) in one of two different positions relative to the handle (20). With further reference to FIGS. 3 and 4, each positioning device (30) comprising a pressing disk (32), a pressed disk (34) and a biasing member (36). The pressing disk (32) is non-rotatably received in the recess (22) in a corresponding one of the second adjusting bases (22) on the handle (20). To keep the pressing disk (32) from rotation relative to the corresponding second adjusting base (22), the recess (222) has multiple ribs (224) formed on the inner surface, and the pressing disk (32) has multiple notches (326) engaging respectively with the ribs (224) in the recess (222).

The pressing disk (32) has a central hole (not numbered), a guiding block (322) and a positioning block (324). The central hole is defined through the pressing disk (32) for the pivot (14) extending through the central hole. The guiding block (322) is formed on the pressing disk (32) at a side far away from the corresponding half casing (21) of the handle (20) and has two curved guiding edges (323) formed respectively on two ends of the guiding block (322). The positioning block (324) is formed on the pressing disk (32) at a side far away from the corresponding half casing (21) of the handle (20) and has two ends.

The pressed disk (34) is non-rotatably received in the recess (122) of the corresponding first adjusting base (12). To keep the pressed disk (34) from rotation relative to the corresponding first adjusting base (12), the recess (122) has multiple ribs (124) formed on the inner surface, and the pressed disk (34) has multiple notches (346) engaging respectively with the ribs (124) in the recess (122).

The pressed disk (34) has a central hole (not numbered), a guiding block (342) and a positioning block (344). The central hole is defined through the pressed disk (34) for the pivot (14) to extend through the central hole. The guiding block (342) is formed on the pressed disk (34) at a side far away from the corresponding half casing (11) of the head (10). The guiding block (342) on the pressed disk (34) has two curved guiding edges (343) formed respectively on two ends of the guiding block (34) and selectively abutting against one end of the positioning block (324) on the corresponding pressing disk (32). The positioning block (344) is formed on the pressed disk (34) at a side far away from the corresponding half casing (11) of the head (10) and has two ends selectively abutting against one of the guiding edges (323) of the guiding block (322) on the corresponding pressing disk (32).

The biasing member (36) is mounted around the pivot (14) and abuts against either the pressing disk (32) or the pressed disk (34) to provide a restituted force to the abutting disk (32,34). In an optional embodiment, the biasing member (36) of one of the positioning devices (30) is received in the recess (122) in the corresponding first adjusting base (12) and abuts against the pressed disk (34), and the biasing member (36) of the other positioning device (30) is received in the recess (222) in the corresponding second adjusting base (22) and abuts against the pressing disk (32). In an alternative embodiment, the biasing members (36) of the positioning devices (30) are both received in the recesses (122,222) in the first adjusting bases (12) or the second adjusting bases (22) to abut against the pressed disks (34) or the pressing disks (32).

Figure 6:
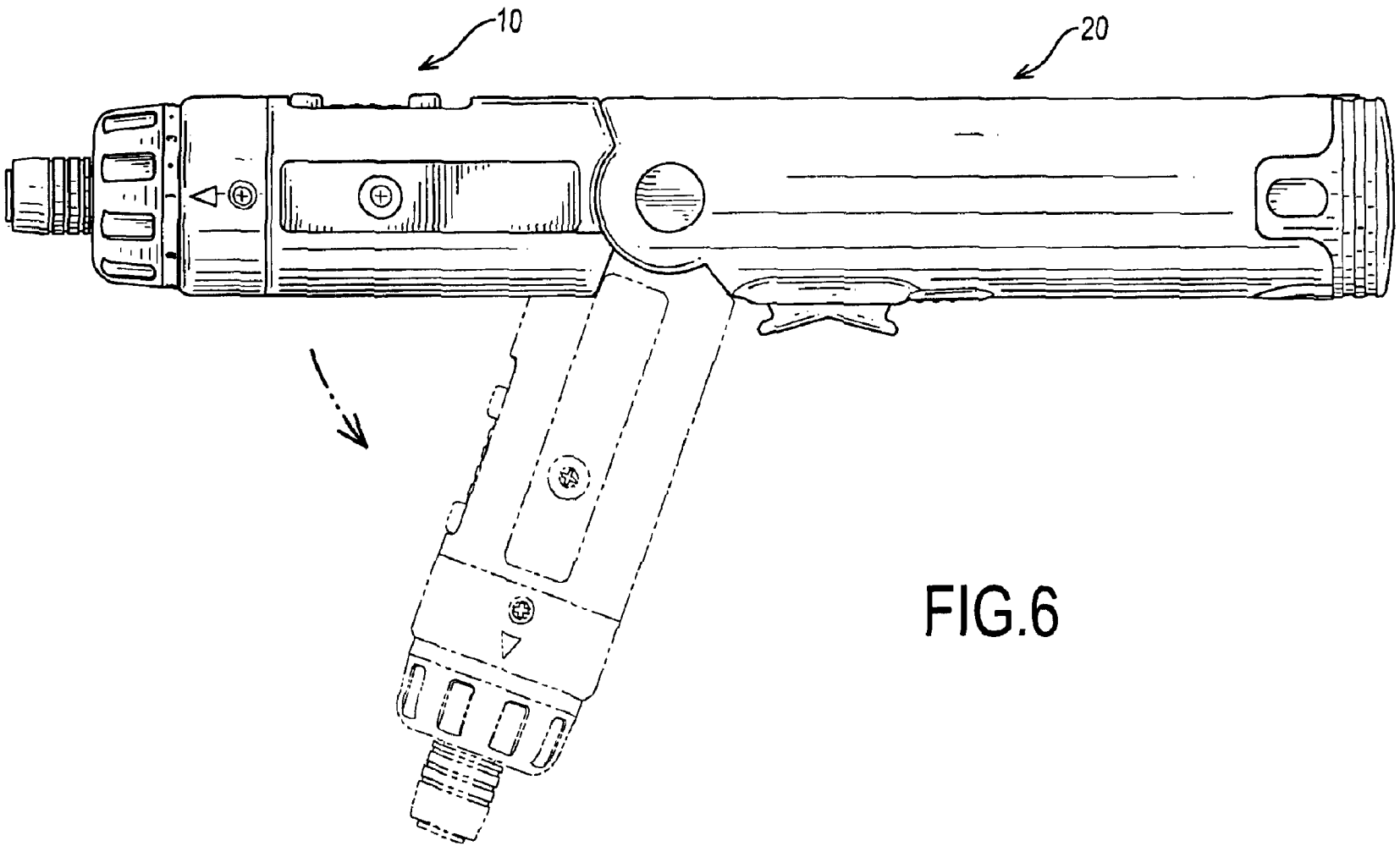
FIG. 6 is an operational side plan view of the hand tool with the housing in FIG. 1.

With the abutments between the guiding blocks (322,342) and the positioning blocks (324,344) on the pressing disks (32) and the pressed disks (34), the head (10) can be kept at a desired position relative to the handle (10), for instance head (10) is straight along the handle (20) as shown in the solid lines in FIGS. 1 and 6. The head (10) can be kept from rotation relative to the handle (20) during the operation of the hand tool.

When the user wants to change the angle between the head (10) and the handle (20), a desired large force is applied to the head (10) to pivotally rotate the head (10) relative to the handle (20). With the force applied to the head (10), the pressed disks (34) of the positioning devices (30) received in the recesses (122) in the first adjusting bases (12) will rotate with the first adjusting bases (12). With the arrangements of the curved guiding edges (323,343) of the guiding blocks (322,342) on the pressing disks (32) and the pressed disks (34), the ends of the positioning blocks (324,344) on the pressing disks (32) and the pressed disks (34) will move along the corresponding curved guiding edges (323,343) on the guiding blocks (322,342). Consequently, the pressing disk (32) or the pressed disk (34) will be pushed to move along the pivot (14) and away from the corresponding pressed disk (34) or pressing disk (32) when the head (10) is rotated. When the head (10) is rotated to another desired position, the positioning blocks (324,344) will move over the corresponding guiding blocks (322,342). One end of each positioning block (324,344) will abut against a corresponding curved guiding edge (323,343) on the corresponding guiding block (322,342) by means of the restituted forces provided by the biasing members (36). Accordingly, the head (10) will be kept at the second position, for example the second position shown in the phantom lines in FIG. 6. Because to push a button is not necessary to adjust the housing between two desired positions, to adjust the angle between the head (10) and the handle (20) of the housing is easy and convenient.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An adjustable housing for a hand tool comprising:

a head with a proximal end, a distal end and composed of two halfcasings combined with each other, and each half casing comprising a first adjusting base formed on the half casing at the proximal end of the head; and a recess with an inner surface defined in the first adjusting base;

a handle with a proximal end pivotally attached to the proximal end of the head, a distal end and composed of two half casings combined with each other, and each half casing of the handle comprising a second adjusting base formed on the half casing at the proximal end of the handle and corresponding to the first adjusting base on a corresponding one of the half casings of the head; and a recess with an inner surface defined in the second adjusting base and facing with the recess in the corresponding first adjusting base;

a pivot extending through the adjusting bases on the head and the handle to pivotally connect the head with the handle; and two positioning devices respectively mounted between the facing recesses of the first and second adjusting bases on the head and the handle and each positioning device comprising a pressing disk non-rotatably received in the recess in a corresponding one of the second adjusting bases on the handle and having a central hole defined through the pressing disk for the pivot extending through the central hole;

a guiding block formed on the pressing disk at a side far away from the corresponding half casing of the handle and having two curved guiding edges formed respectively on two ends of the guiding block; and a positioning block formed on the pressing disk at a side far away from the corresponding half casing of the handle and having two ends;

a pressed disk non-rotatably received in the corresponding first adjusting base and having a central hole defined through the pressed disk for the pivot extending through the central hole a guiding block formed on the pressed disk at a side far away from the corresponding half casing of the head and having two curved guiding edges formed respectively on two ends of the guiding block and selectively abutting against one end of the positioning block on the pressing disk; and a positioning block formed on the pressing disk at a side far away from the corresponding half casing of the handle and having two ends selectively abutting against one of the guiding edges of the guiding block on the pressing disk; and a biasing member abutting against one of the pressing disk and the pressed disk to provide a restituted force to the abutting disk so as to make the pressing disk abut against the pressed disk.

2. The housing as claimed in claim 1, wherein the biasing member of one of the positioning devices is received in the recess in the corresponding first adjusting base on the head and abuts against the pressed disk.

3. The housing as claimed in claim 1, wherein the biasing member of one of the positioning devices is received in the recess in the corresponding second adjusting base on the handle and abuts against the pressing disk.

4. The housing as claimed in claim 1, wherein the recess in each first adjusting base has multiple ribs formed on the inner surface; and each pressed disk has multiple notches engaging respectively with the ribs in the recess on the corresponding first adjusting base to keep the pressed disk from rotation relative to the corresponding first adjusting base.

5. The housing as claimed in claim 1, wherein the recess in each second adjusting base has multiple ribs formed on the inner surface; and each pressing disk has multiple notches engaging respectively with the ribs in the recess on the corresponding second adjusting base to keep the pressing disk from rotation relative to the corresponding second adjusting base.

* * * * *